US012571133B2

(12) United States Patent
Simmelink et al.

(10) Patent No.: US 12,571,133 B2
(45) **Date of Patent: *Mar. 10, 2026**

(54) HOMOGENEOUS FILLED YARN

(71) Applicant: Avient Protective Materials B.V., Geleen (NL)

(72) Inventors: Joseph Arnold Paul Maria Simmelink, Echt (NL); Christoph Hacker, Echt (NL); Roelof Marissen, Echt (NL)

(73) Assignee: AVIENT PROTECTIVE MATERIALS B.V., Geleen (NL)

( * ) Notice: Subject to any disclaimer, the term of this patent is extended or adjusted under 35 U.S.C. 154(b) by 299 days.

This patent is subject to a terminal disclaimer.

(21) Appl. No.: 16/629,986

(22) PCT Filed: Jul. 13, 2018

(86) PCT No.: PCT/EP2018/069134
§ 371 (c)(1),
(2) Date: Jan. 10, 2020

(87) PCT Pub. No.: WO2019/012129
PCT Pub. Date: Jan. 17, 2019

(65) Prior Publication Data

US 2020/0131672 A1 Apr. 30, 2020

(30) Foreign Application Priority Data

Jul. 14, 2017 (EP) ..... 17181449

(51) Int. Cl.

| | |
|---|---|
| ***D01F 6/04*** | (2006.01) |
| ***D01F 1/02*** | (2006.01) |
| *D01F 8/06* | (2006.01) |

(52) U.S. Cl.
CPC ..... *D01F 6/04* (2013.01); *D01F 1/02* (2013.01); *D01F 8/06* (2013.01);
(Continued)

(58) Field of Classification Search
CPC ..... D01F 6/04; D01F 1/02; D01F 8/06; Y10T 428/2929; Y10T 428/2964
(Continued)

(56) References Cited

U.S. PATENT DOCUMENTS

| | | | | |
|---|---|---|---|---|
| 2008/0145301 | A1 | 6/2008 | Van Der Werff et al. | |
| 2015/0018473 | A1* | 1/2015 | Shimizu | C08J 5/10 524/495 |

FOREIGN PATENT DOCUMENTS

| | | |
|---|---|---|
| CN | 101905879 | 12/2010 |
| CN | 102586927 | 11/2013 |

(Continued)

OTHER PUBLICATIONS

International Search Report for PCT/EP2018/069134 dated Sep. 13, 2018, 5 pages.

(Continued)

*Primary Examiner* — Jeremy R Pierce
(74) *Attorney, Agent, or Firm* — NIXON & VANDERHYE P.C.

(57) ABSTRACT

The invention is concerned with filled multifilament yarn according to the present invention whereby the filler ratio, $\chi$, in the yarn is greater than 0.004 times the IV of the UHMWPE present in the multifilament yarn ($IV^{Y}_{UH}$), i.e. $\chi \geq 0.004$ g/dL*$IVy_{H}$, and whereby the tenacity (TEN, in cN/dtex) of the filled multifilament yarn is such that $TEN \geq IV^{Y}_{UH}*(1.5-3.25*\chi)$, or whereby the tenacity of a filled monofilament in the yarn is $ten \geq IV^{Y}_{UH}*(2-4.35*_{X})$.
(Continued)

The invention is further concerned with a method to manufacture said multifilament yarn and articles comprising said multifilament yarn.

27 Claims, 1 Drawing Sheet

(52) U.S. Cl.
CPC . *D10B 2321/0211* (2013.01); *Y10T 428/2929* (2015.01); *Y10T 428/2964* (2015.01)

(58) Field of Classification Search
USPC ..... 428/373
See application file for complete search history.

(56) References Cited

FOREIGN PATENT DOCUMENTS

| | | | |
|---|---|---|---|
| WO | 2006/010521 | 2/2006 | |
| WO | WO-2006010521 A1 * | 2/2006 | ..... B82Y 30/00 |
| WO | 2013/139784 | 9/2013 | |
| WO | 2014/096228 | 6/2014 | |

OTHER PUBLICATIONS

Written Opinion of the ISA for PCT/EP2018/069134 dated Sep. 13, 2018, 7 pages.

* cited by examiner

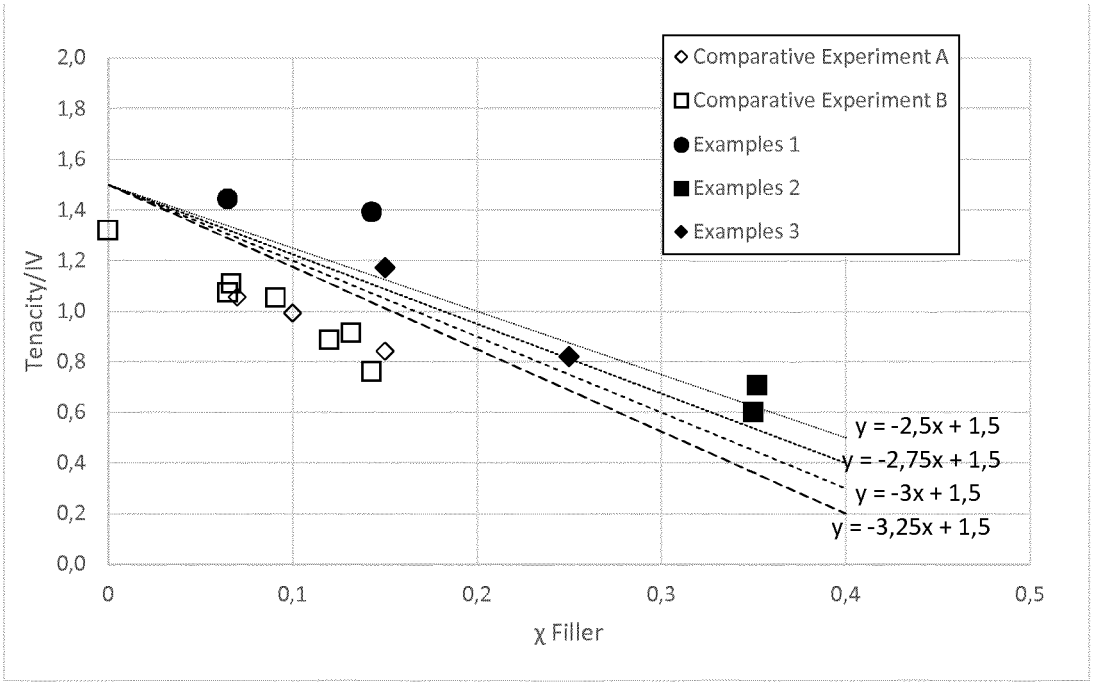
Comparative Experiment A
Comparative Experiment B
Examples 1
Examples 2
Examples 3
Tenacity/IV
2,0
1,8
1,6
1,4
1,2
1,0
0,8
0,6
0,4
0,2
0,0
0
0,1
0,2
0,3
0,4
0,5
χ Filler
y = -2,5x + 1,5
y = -2,75x + 1,5
y = -3x + 1,5
y = -3,25x + 1,5

HOMOGENEOUS FILLED YARN

This application is the U.S. national phase of International Application No. PCT/EP2018/069134 filed Jul. 13, 2018 which designated the U.S. and claims priority to EP application Ser. No. 17/181449.4 filed Jul. 14, 2017, the entire contents of each of which are hereby incorporated by reference.

The present invention relates to a filled multifilament yarn comprising a UHMWPE with an intrinsic viscosity of at most 20 dL/g, a filler with a number average diameter of at most 20 μm in an amount such that the ratio (χ) of the mass of filler to the combined masses of UHMWPE and filler is between 0.02 and 0.50. Furthermore, the present invention directs to a process to produce said filled multifilament yarn. The present invention also relates to the use of the filled multifilament yarn in various applications.

Such a filled multifilament yarn is already known, for instance from documents WO2008046476 and WO2013149990. These documents disclose yarns having high cut resistance, the yarn comprising a hard component having a Mohs hardness of at least 2.5, the hard component being a plurality of hard fibers having an average diameter of at most 25 μm. However, the cut resistant yarn of these document shows a low strength efficiency based on the IV of the employed UHMWPE leading to filled multifilament yarns of which the tenacities are substantially affected by the presence of increased amounts of filler. The yarns of the prior art may have limited strength efficiency and are limited to low amounts of filler.

The objective of the present invention is therefore to provide a filled multifilament yarn not having above deficiencies. Especially it is an objective of the present invention to provide filled multifilament yarns with an improved strength efficiency and/or having an increased filler content at comparable efficiency.

This objective is achieved by a filled multifilament yarn according to the present invention whereby the filler ratio, χ, in the yarn is greater than 0.004 times the IV of the UHMWPE present in the multifilament yarn $$(IV_{UH}^{Y}),\ \text{i.e.}\ \chi \geq 0.004\ \text{g/dL} * IV_{UH}^{Y},$$

and whereby the tenacity (TEN, in cN/dtex) of the filled multifilament yarn is such that $TEN \geq IV_{UH}^{Y} * (1.5-3.25*\chi)$.

The advantage of the yarn of the invention is that at similar strength efficiency a higher filler content can be achieved, providing filled multifilament yarns with further increase cut resistance or other properties provided by the filler present in the yarn, such as colorability, color intensity and density. The yarns of the invention have also improved mechanical and physical properties. Moreover, it was surprisingly found that the yarns of the invention show improved handling, especially at elevated speeds as for example in coating processes or in processes including yarn winding and/or high speed yarn transportation. This is observed in that the filled multifilament yarns according to the present invention limits or prevents filament breakage and subsequent yarn breakage and/or reduces amount of dust emission during manufacturing and processing of the yarns into articles, avoiding quality issues and down time during production.

Within the context of the present invention, multifilament yarn, or simply yarn, is understood to mean an elongated body comprising a plurality of, i.e. at least 2, preferably at least 5, fibers. Herein fibers are understood to be elongated bodies with length dimension much greater than their transversal dimensions, e.g. width and thickness. The term fiber includes a monofilament, a ribbon, a strip or a tape and the like, and can have a regular or an irregular cross-section. The fibers may have continuous lengths, known in the art as filaments, or discontinuous lengths, known in the art as staple fibers.

The present invention also relates to a filled multifilament yarn comprising

- a UHMWPE with an intrinsic viscosity ($IV_{UH}^{Y}$) of <20 dL/g,
- a filler with an average diameter of at most 20 μm in an amount such that the ratio (χ) of the mass of filler to the combined masses of UHMWPE and filler is between 0.02 and 0.50, with $\chi \geq 0.004\ \text{g/dL} * IV_{UH}^{Y}$, whereby the tenacity (ten, in cN/dtex) of a filled monofilament of the filled multifilament yarn is such that $ten \geq IV_{UH}^{Y} * (2-4.35*\chi)$, preferably the tenacity of the filled monofilament is such that $ten \geq IV_{UH}^{Y} * (2.5-4*\chi)$. The tenacity (TEN) of the filled multifilament yarn containing the filled monofilament may be such that $TEN \geq IV_{UH}^{Y} * (1.5-3.25*\chi)$. Said filled multifilament yarn also shows improved strength efficiency and/or has an increased filler content at comparable efficiency, providing filled multifilament yarns with further increase in cut resistance or other properties, such as colorability, color intensity and density. Moreover, said yarn also show improved handling, especially at elevated speeds as for example in coating processes or in processes including yarn winding and/or high speed yarn transportation. This is observed in that the filled multifilament yarns according to the present invention limits or prevents filament breakage and subsequent yarn breakage and/or reduces amount of dust emission during manufacturing and processing of the yarns into articles, avoiding quality issues and down time during production.

The filled multifilament yarns of the invention comprise a UHMWPE with an intrinsic viscosity ($IV_{UH}^{Y}$). By UHMWPE is herein understood a polyethylene having an intrinsic viscosity (IV) as measured on solution in decalin at 135° C., of at least 5 dL/g. Preferably, the IV of the UHMWPE is at least 6 dL/g, more preferably at least 7 dL/g, most preferably at least 8 dL/g. Preferably, the IV is at most 20 dL/g, more preferably at most 18 dL/g, even more preferably at most 16 dL/g, most preferably at most 14 dL/g.

The filled multifilament yarns according to the invention preferably contain of from 2.0 wt. % to 50 wt. % of the filler, preferably of from 4.0 wt. % to 40 wt. %, yet preferably of from 5.0 wt % to 35 wt %, even more preferably of from 6.0 wt. % to 30 wt. %, based on the total weight filler and UHMWPE present in the fibers of the multifilament yarns. The amount of filler is alternatively expressed as the filler ratio χ, being the ratio of the mass of filler to the combined masses of UHMWPE and filler present in the fibers of the multifilament yarns. In agreement with the above, said ratio χ is between 0.02 and 0.50, preferably between 0.04 and 0.40, yet preferably between 0.05 and 0.35, and even more preferably between 0.06 and 0.30.

An important aspect of the invention is the discovery that the strength efficiency of filled multifilament yarns of UHMWPE may be increased when during the manufacturing process the UHMWPE and the level of filler are judiciously selected, especially in that the amount of filler employed in the process is such that the filler ratio (χ), is at least 0.003 times the intrinsic viscosity of the UH employed in the process ($IV_{UH}^{0}$), in other words that $\chi \geq 0.003$ g/dL*$IV_{UH}^{0}$. The amount of filler employed in the process is substantially the same as the filler amount in the final product, e.g. in the yarn or article. Preferably the level of filler and the UHMWPE should be such that $\chi \geq 0.0033$ g/dL*$IV_{UH}^{0}$, more preferably that $\chi \geq 0.0035$ g/dL*$IV_{UH}^{0}$, even more preferably that wherein $\chi \geq 0.0038$ g/dL*$IV_{UH}^{0}$, and most preferably that $\chi \geq 0.004$ g/dL*$IV_{UH}^{0}$. It was observed that at such relation between the filler ratio and IV of the UHMWPE employed in the spinning process unexpectedly results in a higher strength efficiency of the employed UHMWPE. Filled multifilament yarns are obtained, allowing a stable production of multifilament yarns at higher filler levels, substantially higher than described in the prior art. The relation of the intrinsic viscosity of the UHMWPE employed in the spinning process to the filler ratio is not specifically limited at its upper end, nevertheless the level of filler and $IV_{UH}^{0}$ of UHMWPE should be such that $\chi \geq 0.1$ g/dL*$IV_{UH}^{0}$, preferably $\chi \leq 0.04$ g/dL*$IV_{UH}^{0}$.

The judicious selection of filler content and UHMWPE provides yarns with an improved strength efficiency. By strength (or tenacity) efficiency is herein understood the achieved strength (tenacity, TEN, in cN/dtex) of a multifilament yarn or monofilament in a multifilament yarn (ten, cN/dtex) divided by the intrinsic viscosity of the UHMWPE present in said yarn or monofilament ($IV_{UH}^{Y}$), otherwise expressed as the ratio TEN/$IV_{UH}^{Y}$ or ten/$IV_{UH}^{Y}$, respectively. For unfilled yarns such efficiency is typically in the range of 0.5 to 1.5, whereby higher efficiencies are an indication for more optimized production processes. The presence of fillers during the production process substantially affects, i.e. lowers, the strength efficiency as can be observed from the data in Table 1 and FIG. 1.

The present invention now describes a multifilament yarn and a process which surprisingly outperforms the relationship of strength efficiency and filler content, i.e. the strength (tenacity) achieved at varying filler content. Said multifilament yarn has the formula TEN/$IV_{UH}^{Y} \geq 1.5-3.25*\chi$, or rewritten as TEN$\geq IV_{UH}^{Y}*(1.5-3.25*\chi)$, as depicted as dotted line in FIG. 1. Preferably the tenacity of the filled multifilament yarn is such that TEN$\geq IV_{UH}^{Y}*(1.5-3.00*\chi)$, more preferably TEN$\geq IV_{UH}^{Y}*(1.5-2.75*\chi)$ and most preferably TEN$\geq IV_{UH}^{Y}*(1.5-2.50*\chi)$, also depicted as interrupted lines in FIG. 1. The present invention also describes that the tenacity (ten, in cN/dtex) of a filled monofilament of a filled multifilament yarn is such that ten$\geq IV_{UH}^{Y}*(2-4.35*\chi)$, wherein the multifilament yarn containing such a monofilament and the process to make the yarn also surprisingly outperforms the relationship of strength efficiency and filler content, i.e. the strength (tenacity) achieved at varying filler content.

During the manufacturing process of the inventive yarn, the UHMWPE is subjected to a combination of thermal, mechanical and chemical degradation resulting in a reduction of the intrinsic viscosity of the UHMWPE. Accordingly, the intrinsic viscosity of the UHMWPE present in the inventive yarns ($IV_{UH}^{Y}$) is different from, and lower than, the intrinsic viscosity of the UHMWPE provided to the manufacturing process ($IV_{UH}^{0}$). Experimentally it was identified that the reduction of the IV during the manufacturing process is at the level of 25 to 40%, but is depending upon a multitude of parameters like polymer concentration, filler content, solvent type, processing temperature, etc. Therefore in one embodiment of the invention the multifilament yarns comprise an amount of filler, $\chi$, and a UHMWPE with an intrinsic viscosity ($IV_{UH}^{Y}$) such that with $\chi \geq 0.0045$ g/dL*$IV_{UH}^{Y}$. Preferably the level of filler and IV of UHMWPE should be such that $\chi \geq 0.005$ g/dL*$IV_{UH}^{Y}$, more preferably such that $\chi \geq 0.0055$ g/dL*$IV_{UH}^{Y}$ even more preferably such that $\chi \geq 0.006$ g/dL*$IV_{UH}^{Y}$, and most preferably such that $\psi \geq 0.007$ g/dL*$IV_{UH}^{Y}$.

It was further observed that the filled multifilament yarns according to the invention may show increased homogeneity of yarn properties, especially less variability of the titer of the individual filaments in a yarn, less variability of the tenacities of the individual filaments in a yarn and/or less variability of the yarn tenacity along the yarn length.

Accordingly a preferred embodiment of the invention, is a multifilament yarn according to the invention wherein the coefficient of variation in linear density (dpf) between the (individual) filaments of said yarn, hereafter $CV_{inter}^{dpf}$, is at most 12%, wherein the $CV_{inter}^{dpf}$ of a yarn is determined from linear density values x corresponding to a number of 10 representative lengths, wherein each of said lengths corresponds to a different randomly sampled filament of said yarn and using Formula $$CV_{inter}^{dpf} = \sqrt{\frac{\sum_{i=1}^{n}(x_i - \bar{x})^2}{n-1}} \times \frac{1}{\bar{x}} \times 100 \quad \text{Formula 1}$$

wherein $x_i$ is the linear density of any one of the 10 representative lengths under investigation and $\bar{x}$ is the averaged linear density over the n=10 measured linear densities of said n=10 representative lengths. Preferably, the $CV_{inter}^{dpf}$ of the inventive yarn is less than 10%, more preferably less than 8%. Filled multifilament yarns with such reduced $CV_{inter}^{dpf}$ values are for example obtained with the process of the invention as explained below.

Another preferred embodiment of the invention is a multifilament yarn wherein the coefficient of variation in tenacity (ten) between the (individual) filaments of said yarn, hereafter $CV_{inter}^{ten}$, is at most 12%, wherein the $CV_{inter}^{ten}$ of a yarn is determined from tenacity values y corresponding to a number of 10 representative lengths, wherein each of said lengths corresponds to a different randomly sampled filament of said yarn and using Formula 2, $$CV_{inter}^{ten} = \sqrt{\frac{\sum_{i=1}^{n}(y_i - \bar{y})^2}{n-1}} \times \frac{1}{\bar{y}} \times 100 \quad \text{Formula 2}$$

wherein $y_i$ is the tenacity of any one of the 10 representative lengths under investigation and $\bar{y}$ is the averaged tenacity over the n=10 measured tenacities of said n=10 representative lengths. Preferably, the $CV_{inter}^{ten}$ of the inventive yarn is less than 10%, more preferably less than 8%. Filled multifilament yarns with such reduced $CV_{inter}^{ten}$ values are for example obtained with the process of the invention as explained below.

Yet another preferred embodiment of the invention is a multifilament yarn wherein the coefficient of variation of the Tenacity (TEN) of the multifilament yarn, hereafter $CV_{intra}^{TEN}$, is at most 1.0%, wherein the $CV_{inta}^{TEN}$ of the multifilament yarn is determined from yarn tenacity values z corresponding to a number of 5 representative yarn lengths randomly sampled from said multifilament yarn and using Formula 3, $$CV_{intra}^{TEN} = \sqrt{\frac{\sum_{i=1}^{n}(z_i - \bar{z})^2}{n-1}} \times \frac{1}{\bar{z}} \times 100 \quad \text{Formula 3}$$

wherein $z_i$ is the yarn tenacity of any one of the 5 representative yarn lengths under investigation and $\bar{z}$ is the averaged yarn tenacity over the n=5 measured tenacities of said n=5 representative yarn lengths. Preferably, the $CV_{intra}^{TEN}$ of the inventive yarn is less than 0.8%, more preferably less than 0.6%. Filled multifilament yarns with such reduced $CV_{intra}^{TEN}$ values are for example obtained with the process of the invention as explained below. This embodiment of the invention demonstrates the commercial relevance of the current invention in that the $CV_{intra}^{TEN}$ value is typically reported and demonstrates the consistency of a production process.

In above embodiments, the representative yarn lengths and representative filament lengths of a single filament are understood to be lengths of a yarn or filament from an identical production period, i.e. a sample of a few hundred meters during or after the production and not length spread over a (commercial) production run. Accordingly, the representative filament length of a yarn are randomly selected samples from a specific section of said yarn and not from different yarn sections, let alone from different yarn sections spread over a production run.

By filler in the context of the invention is understood a component immiscible with UHMWPE and substantially solid up to the processing conditions of the UHMWPE multifilament yarns. Such filler may affect one or more properties of the yarn such as its density, cute resistance, color, abrasion resistance, etc. Said filler may comprises or consist of particles made of a material with a hardness higher than the hardness of the molded article measured in the absence of the filler and may be organic or inorganic. If the filler is organic it is preferably a polymer with a melting temperature of at least 150° C., preferably at least 200° C. Preferably the material is inorganic material. By inorganic material in the context of the present invention is understood a material substantially devoid of covalently bond carbon atoms and hence exclude any organic material such as hydrocarbons and especially polymeric materials. In particular inorganic material refers to compounds comprising metals, metal oxides, clay, silica, silicates or mixtures thereof but also include carbides, carbonates, cyanides, as well as the allotropes of carbon such as diamond, graphite, graphene, fullerene and carbon nanotubes. The use of filler comprising inorganic materials provides multifilament yarns with optimized secondary properties such as abrasion and cut resistance. Preferably the inorganic material is glass, a mineral, a metal or carbon fibers.

Preferably the material that is used to produce the filler has a Moh's hardness of at least 2.5, more preferably at least 4, most preferably at least 6. Useful materials include, but are not limited to, metals, metal oxides, such as aluminum oxide, metal carbides, such as tungsten carbide, metal nitrides, metal sulfides, metal silicates, metal silicides, metal sulfates, metal phosphates, and metal borides. Other examples include silicon dioxide and silicon carbide. Other ceramic materials and combination of the above materials may also be used.

The particle size, particle size distribution, particle diameter and the amount of the filler are all important parameters in optimizing yarn properties such as cut resistance while achieving a homogeneous multifilament yarn. A particulate form of the filler may be used, with a powder being generally suitable. For particles with no dimension substantially larger than the other dimensions of the particle, such as particles of spherical or cubical shape, the average particle size is substantially equal to the average particle diameter, or in short the diameter. In the context of the present invention average means number (or numerical) average if not stated differently. For particles of substantially oblong shape, e.g. elongated or non-spherical or anisotropic, such as needles, fibrils or fibers, the particle size may refer to the average length dimension (L), along the long axis of the particle, whereas the average particle diameter, or in short the diameter as may be also referred herein, refers to the average diameter of the cross-section that is perpendicular to the length direction of said oblong shape. In case the cross-section of the particle is not circular, the average diameter (D) is determined with following formula: $D=1.15*A^{1/2}$, wherein A is the cross-section area of the particle.

Selection of an appropriate particle size, diameter and/or length depends on the processing and on the filament titer of the multifilament yarn. Nevertheless the particles should be small enough to pass through the spinneret apertures. The particle size and diameter may be selected small enough to avoid appreciable deterioration of the fiber tensile properties. The particle size and diameter may have a log normal distribution.

The average diameter of the filler is at most 20 μm, preferably at most 16 μm and even more preferably at most 12 μm. Fillers with lower average diameter may result in increased homogeneity of the yarn and may lead to less surface defects on the filaments. Higher filler diameter lead to processing difficulties and deterioration of mechanical strength.

Preferably, the average diameter of the filler is at least 0.01 μm, preferably at least 0.1 μm, even more preferred 1 μm and most preferred at least 3 μm. Fillers with larger average diameter may result in an optimized molding step in the process of the present invention.

Preferably, the average diameter of the filler is at least 0.01 μm and at most 20 μm, more preferably the average diameter of the filler is at least 0.1 μm and at most 20 μm, yet more preferably the average diameter of the filler is at least 1 μm and at most 20 μm, most preferably is at least 3 μm and at most 20 μm, yet most preferably the average diameter of the filler is at least 3 μm and at most 16 μm, yet most preferably the average diameter of the filler is at least 3 μm and at most 12 μm.

Preferably, the average length (L) of the filler is at most 10000 μm, more preferably at most 5000 μm, most preferably at most 3000 μm. It was also observed that when the filler are having an average length of at most 1000 μm, more preferably at most 750 μm, most preferably at most 650 μm, articles of the invention and in particular a glove comprising the filled multifilament yarn of the invention shows a good dexterity. Preferably said average length of said hard fibers is at least 50 μm, more preferably at least 100 μm, most preferably at least 150 μm, yet most preferably at least 200 μm.

The filler present in the filled multifilament yarns may be particles that may have an aspect ratio L/D of about 1. The filler present in the filled multifilament yarn may be in the form of fibers that may have an aspect ratio L/D of at least 2, preferably at least 3, more preferably at least 5, yet preferably at least 10, and even more preferably at least 20. The filler in the multifilament yarns may comprise or consist of particles and/or fibers.

Any filler known in the art can be used. Suitable fillers are already commercially available, as used also in the Examples section of this invention. Fillers and methods to add the filler to the HPPE fiber are well-known to the skilled person in the art and described, for instance, in document WO9918156A1, which is incorporated herein by reference and in WO2008046476, which is incorporated herein by reference, and in WO2013149990, which is incorporated herein by reference.

The aspect ratio of the filler is the ratio between the length, i.e. average length (L) and the diameter, i.e. average diameter (D) of the filler. The average diameter and the aspect ratio of the filler may be determined by using any method known in the art, for instance SEM pictures. For measuring the diameter it is possible to make a SEM picture of the filler, e.g. fibers as such, spread out over a surface and measuring the diameter at 100 positions, ad randomly selected, and then calculating the arithmetic average of the so obtained 100 values. For the aspect ratio it is possible to make a SEM picture of the filler, e.g. fibers and to measure the length of the filler, e.g. fibers that show up at or just below the surface of the HPPE fiber. Preferably the SEM pictures are made with backscattered electrons, providing a better contrast between the fibers and surface of the HPPE fiber.

The filler may be continuous or spun fibers, in particular spun fibers. Suitable examples of spun fibers are glass or mineral fibers that may be spun by rotation techniques well known to the skilled person. It is possible to produce the fibers as continuous filaments that are subsequently milled into fibers of much shorter length. Said milling process may reduce the aspect ratio of at least part of the fiber. Alternatively, discontinuous filaments may be produced, e.g. by jet spinning, optionally subsequently milled and used in the multifilament yarn of the present invention. The fibers may be subjected to a reduction of their aspect ratio during the production process of the multifilament yarn.

Carbon fibers may be used as the filler. Most preferably, carbon fibers having a diameter of between 3 and 10 μm, more preferably between 4 and 6 μm are used. Articles containing the carbon fibers show improved electrical conductivity, enabling the discharge of static electricity.

The filaments, also referred to as monofilaments, of the filled multifilament yarns may have a linear density of at most 20 dtex, preferably at most 15 dtex, most preferably at most 10 dtex, as articles comprising such filaments are very flexible, providing a high level of comfort to the persons that wear the article. The filament has preferably a titer of at least 1 dtex, more preferably at least 2 dtex.

The titer of the filled multifilament yarns is not specifically limited. For practical reasons, the titer of the multifilament yarns can be at most 10000 dtex, preferably at most 6000 dtex, more preferably at most 3000 dtex. Preferably, the titer of said yarns is in the range of 50 to 10000 dtex, more preferably 100 to 6000 and most preferably in the range from 200 to 3000 dtex, yet most preferably in the range of from 220 to 800 dtex, yet most preferably of from 100 to 2000 dtex.

The filled multifilament yarns of the present invention preferably are high performance polyethylene (HPPE) yarns, preferably the multifilament yarns have a tenacity of at least 5.0 cN/dtex, more preferably at least 7.5 cN/dtex, yet more preferably at least 10.0 cN/dtex, more preferably at least 12.5 cN/dtex, even more preferably at least 15.0 cN/dtex and most preferably at least 20.0 cN/dtex.

In the context of the present invention, the UHMWPE may be linear or branched, whereby linear polyethylene is preferred. Linear polyethylene is herein understood to mean polyethylene with less than 1 side chain per 100 carbon atoms, and preferably with less than 1 side chain per 300 carbon atoms; a side chain or branch generally containing at least 10 carbon atoms. Side chains may suitably be measured by FTIR. The linear polyethylene may further contain up to 5 mol % of one or more other alkenes that are copolymerisable therewith, such as propene, 1-butene, 1-pentene, 4-methylpentene, 1-hexene and/or 1-octene.

The filled multifilament yarns of the invention may have higher filler levels and an optimized strength efficiency beneficial for the quality of articles made from said yarns. Therefore, one embodiment of the present invention concerns articles comprising the filled multifilament yarns of the invention. Articles containing the yarns of the invention may be, but are not limited to product chosen from the group consisting of fishing lines, fishing nets, ground nets, cargo nets, curtains, kite lines, dental floss, tennis racquet strings, canvas, woven cloths, nonwoven cloths, webbings, battery separators, medical devices, capacitors, pressure vessels, hoses, umbilical cables, automotive equipment, power transmission belts, building construction materials, cut resistant articles, stab resistant articles, incision resistant articles, protective gloves, composite sports equipment, skis, helmets, kayaks, canoes, bicycles and boat hulls, speaker cones, high performance electrical insulation, radomes, sails, and geotextiles.

Fabrics containing the filled multifilament yarns according to the invention may be made by knitting, weaving or by other methods, by using conventional equipment. It is also possible to produce non-woven fabrics. The fabrics comprising the yarn according to the invention may have a cut resistance that is 20% higher than the same fabric, produced from the yarn not containing the filler, as measured by the Ashland Cut Protection Performance Test. Preferably the cut resistance of the fabric is at least 50% higher, more preferably at least 100% higher, even more preferably at least 150% higher.

The filled multifilament yarns according to the invention are suitably used in all kind of products, like garments intended to protect persons from being cut, the persons working in the meat industry, the metal industry and the wood industry. Examples of such garments include gloves, aprons, trousers, cuffs, sleeves, etc. Other possible applications include side curtains and tarpaulins for trucks, soft sided luggage, commercial upholstery, airline cargo container curtains, fire hose sheathes etc. Surprisingly the yarns according to the invention are also very suitable for use in products used for protection against injury by stabbing, for example by a knife or an ice pick. An example of such a product is a vest for life protection used by police officers Preferably in such a structure the yarns according to the invention are located at the side of the structure where the structure will be first hit by the sharp object that is used for the penetration.

The filled multifilament yarns may be obtained by various processes known in the art, for example by a melt spinning process or a gel spinning process, as also described herein. The gel-spinning process is for example described in EP 0205960 A, EP 0213208 A1, U.S. Pat. No. 4,413,110, GB 2042414 A, EP 0200547 81, EP 0472114 B1, WO01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning the multifilament from a solution of ultra-high molecular weight polyethylene in a spin solvent; cooling the filament obtained to form a gel filament; removing at least partly the spin solvent from the gel filament; and drawing the filament in at least one drawing step before, during or after removing spin solvent.

In the process according to the invention any of the known solvents suitable for gel spinning of UHMWPE may be used, hereinafter said solvents being referred to as spin solvents. Suitable examples of spin solvents include aliphatic and alicyclic hydrocarbons such as octane, nonane, decane and paraffins, including isomers thereof; petroleum fractions; mineral oil; kerosene; aromatic hydrocarbons such as toluene, xylene, and naphthalene, including hydrogenated derivatives thereof such as decalin and tetralin; halogenated hydrocarbons such as monochlorobenzene; and cycloalkanes or cycloalkenes such as careen, fluorine, camphene, menthane, dipentene, naphthalene, acenaphtalene, methylcyclopentandien, tricyclodecane, 1,2,4,5-tetramethyl-1,4-cyclohexadiene, fluorenone, naphtindane, tetramethyl-p-benzodiquinone, ethylfuorene, fluoranthene and naphthenone. Also combinations of the above-enumerated spinning solvents may be used for gel spinning of UHMWPE, the combination of solvents being also referred to for simplicity as spin solvent. It is found that the present process is especially advantageous for relatively volatile solvents, like decalin, tetralin and several kerosene grades. In the most preferred embodiment the solvent of choice is decalin. Spin solvent can be removed by evaporation, by extraction, or by a combination of evaporation and extraction routes.

The invention also relates to a process for producing the filled multifilament yarns according to the invention by:

a) providing a UHMWPE having an intrinsic viscosity ($IV_{UH}^{0}$) of less than 24 dL/g, preferably of less than 20 dL/g,
b) providing a filler with an average diameter of at most 20 μm,
c) preparing a solution of the UHMWPE in a solvent, the solution comprising said filler in an amount such that the ratio ($\chi$) of the mass of filler to the combined masses of UHMWPE and filler is between 0.02 and 0.50,
d) spinning the solution obtained in step c) through a multiple orifice die plate to form a solvent containing filled multifilament yarn,
e) at least partially removing the solvent from the filled yarn of step d) before, during or after drawing the filled yarn at a total draw ratio of at least 20, to obtain said filled multifilament yarn, whereby the amount of filler is chosen such that $\chi \geq 0.003$ g/dL*$IV_{UH}^{0}$.

The selection of UHMWPE, filler as well as the ratio $\chi$ are preferably made according to the earlier preferred embodiments for said UHMWPE, filler and ration defining the embodiment of the inventive filled multifilament yarns. Accordingly, a preferred embodiment of the inventive process is to select the ratio ($\chi$) of the mass of filler to the combined masses of UHMWPE and filler to be between 0.04 and 0.40, or other ranges and levels mentioned above. Another preferred embodiment of the process of the invention is to select the filler ratio $\chi$ and the UHMWPE such that $\chi \geq 0.0035$ g/dL*$IV_{UH}^{0}$, or within the preferred limitations provided above.

Standard equipment may be used for this process, preferably a twin screw extruder, wherein in the first part the polymer is dissolved in the solvent, wherein at the end of the first part the fibers are fed to the extruder via a separate feed opening.

It is also possible to convert the yarns obtained in above-mentioned processes into staple fibers and to process these staple fibers into a yarn.

Also included in the scope of the invention are so-called composite yarns and products containing such a yarn. Such a composite yarn for example contains one or more single yarns containing filaments and/or staple fibers containing the filler and one or more further single yarns or a glass, metal or ceramic yarn, wire or thread.

In the described methods to prepare the filled multifilament yarns drawing, preferably uniaxial drawing, of the produced yarn may be carried out by means known in the art. Such means comprise extrusion stretching and tensile stretching on suitable drawing units. To attain increased mechanical tensile strength and stiffness, drawing may be carried out in multiple steps. Drawing is preferably carried out uniaxially in a number of drawing steps. The first drawing step may for instance comprise drawing to a stretch factor (also called draw ratio) of at least 1.5, preferably at least 3.0. Multiple drawing may typically result in a stretch factor of up to 9 for drawing temperatures up to 120° C., a stretch factor of up to 25 for drawing temperatures up to 140° C., and a stretch factor of 50 or above for drawing temperatures up to and above 150° C. By multiple drawing at increasing temperatures, stretch factors of about 50 and more may be reached. This results in filled multifilament yarns tenacities of 5.0 cN/dtex to 30 cN/dtex and more may be obtained. The individual draw ratio in the liquid phase, the gel phase and the solid phase can be expressed in combination as the total draw ratio.

The filled multifilament yarns according to the present invention can further comprise other fibers, that may be in the form of filaments and/or staple fibers, that are different than the described filled filaments, e.g. different in composition and/or shape, such as non-polymeric fibers, e.g. glass fibers, carbon fibers, basalt fibers, metal wire or thread; and/or natural fibers, e.g. cotton; bamboo; and/or polymeric fibers, e.g. polyamide fibers, such as nylon fibers, elastic fibers, e.g. elastane fibers, polyester fibers; and/or mixtures of these other fibers, that may be present in any ratio.

The invention will be further explained by the following examples and comparative experiment, however first the methods used in determining the various parameters useful in defining the present invention are hereinafter presented.

Methods

Linear density of yarn: titer of yarns was measured by weighing 100 meters of yarn. The dtex of the yarn was calculated by dividing the weight (expressed in milligrams) by 10.

IV: the Intrinsic Viscosity of the UHMWPE is determined according to method ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration.

Tensile properties of yarns (TEN): tenacity and modulus are defined and determined on multifilament yarns as specified in ASTM D885M, using a nominal gauge length of the fiber of 500 mm, a crosshead speed of 50%/min and Instron 2714 clamps, of type "Fiber Grip D5618C". On the basis of the measured stress-strain curve the modulus is determined as the gradient between 0.3 and 1% strain. For calculation of the modulus and strength, the tensile forces measured are divided by the titre.

Tensile properties of filaments (ten): tenacity are defined and determined on monofilaments with a procedure in accordance with ISO 5079:1995, using a Textechno's Favimat (tester no. 37074, from Textechno Herbert Stein GmbH & Co. KG, Monchengladbach, Germany) with a nominal gauge length of the fibre of 50 mm, a crosshead speed of 25 mm/min and clamps with standard jaw faces (4*4 mm) manufactured from Plexiglas® of type pneumatic grip. The filament was preloaded with 0.04 cN/dtex at the speed of 25 mm/min. For calculation of the tenacity the tensile forces measured are divided by the filament linear density (titer);

Linear density: Determination of the linear density of monofilaments was measured according to ASTM D1577-01, carried out on a semiautomatic, microprocessor controlled tensile tester (the Favimat, tester no. 37074, from Textechno Herbert Stein GmbH & Co. KG, Monchengladbach, Germany). A representative length of the monofilament to be tested was cut from said monofilament with a sharp blade, clamped with two small piece of paper (4×4 mm) between two (4×4×2 mm) jaw faces manufactured from Plexiglas®. The length was enough to ensure a good mounting of the monofilament and was about 70 mm.

The linear density of the monofilament length between the clamp jaws is determined vibroscopically as described above by following the routines implemented in the tester's software and described in the tester's manual. The distance between the jaws during measurements is kept at 50 mm, the monofilament being tensioned at 0.6 cN/dtex with a speed of 2 mm/min.

Number of olefinic branches per thousand carbon atoms was determined by FTIR on a 2 mm thick compression molded film by quantifying the absorption at 1375 $cm^{-1}$ using a calibration curve based on NMR measurements as in e.g. EP0269151 (in particular pg. 4 thereof).

Average length and average diameter were measured by using the CottonscopeHD analysis system.

Dust emission (amount of filler released during processing, based on the total amount of yarn processed, g/kg yarn) was determined during the yarn spooling/processing stage by positioning a white paper below the samples during the yarn spooling/processing stage and measuring then the amount of dust collected during 20 minutes.

The amount of filler in a yarn (wt %) was determined as the weight difference between the initial weight of the yarn and the weight of the yarn left after burning the polymer in the yarn (measured by weighing the ash content obtained after burning). Burning took place by heating the yarns at a temperature of 700° C.

Cut resistance was determined according to ISO 13997-1999 after knitting fabrics of 380 or 260 grams per square meter of the corresponding 440 or 220 dtex yarns.

EXAMPLES

Comparative Experiment A and B (CE A and CE B)

Yarns of type A were produced following the process of Example 1 of WO2013149990 whereby a UHMWPE with an $IV_{UH}^{0}$ of 27.0 dL/g was dry blended with an amount of 7 wt. %, 10 wt. % and 15 wt. % of mineral fibrils sold under the trade name CF10ELS by Lapinus, NL (numerical average diameter of 7.4 μm, average length of 70 μm, Moh's hardness of 3.5), for Comparative Experiments CE A-1, CE A-2 and CE A-3 respectively, and subsequently dissolved in decalin, to a total solids content (i.e. total content of polymer and filler) concentration of 9 wt. %. The so obtained solution was fed to a twin-screw extruder having a screw diameter of 25 mm, equipped with a gear pump. The solution was heated in this way to a temperature of 180° C. The solution was pumped through a spinneret having 64 holes, each hole having a diameter of 1 millimeter. The so obtained filaments were drawn in total with maximum drawing factor in the range of 170-200 and dried in a hot air oven. After drying the filaments were bundled into a yarn and wound on a bobbin. $IV_{UH}^{Y}$ of fiber CE A-1 was measured at 22.2 dL/g.

Yarn of type B were obtained as described for yarn A with the difference that a UHMWPE with an $IV_{UH}^{0}$ of 22.0 dL/g and different mineral fibers levels were used. The obtained filaments were drawn in total with a factor in the range of 180 to 210. $IV_{UH}^{Y}$ of fiber CE B-2 was measured at 15.0 dL/g.

Subsequently yarns A and B were subjected to tensile measurements. Details about fiber composition, process and properties of CE A and CE B yarns are provided in Table 1.

TABLE 1

| | X | $IV_{UH}^{Y}$ [dL/g] | Total Draw Ratio | TEN [cN/dtex] | TEN/IV | Cut Force [N] | Yarn count [dtex] | Dust emission [g/kg yarn |
|---|---|---|---|---|---|---|---|---|
| CE A-1 | 0.067 | 22.2 | 183 | 23.2 | 1.05 | 9.6 | 440 | — |
| CE A-2 | 0.099 | 22.2 | 182 | 21.8 | 0.99 | — | 440 | — |
| CE A-3 | 0.152 | 22.2 | 183 | 18.5 | 0.84 | — | 440 | — |
| CE B-1 | 0 | 15 | 214 | 19.8 | 1.32 | — | 220 | — |
| CE B-2 | 0.065 | 15 | 209 | 16.3 | 1.07 | 6.4 | 220 | 1.23 |
| CE B-3 | 0.091 | 15 | 209 | 15.8 | 1.05 | 6.5 | 220 | — |
| CE B-4 | 0.12 | 15 | 207 | 13.3 | 0.89 | 8.8 | 220 | — |
| CE B-5 | 0.132 | 15 | 208 | 13.7 | 0.91 | 7.1 | 220 | — |
| CE B-6 | 0.143 | 15 | 206 | 11 | 0.76 | 7.4 | 220 | — |
| CE B-7 | 0.067 | 15 | 208 | 16.6 | 1.11 | 6.5 | 220 | — |

Example 1 (Ex. 1)

Yarns Ex 1-1 and 1-2 were obtained as described for yarn A with the difference that a UHMWPE with an IV of 17.0 dig with respectively 14.3 wt. % and 6.5 wt. % of filler. The obtained filaments were drawn in total with a factor in the range of 200 to 210. Polymer IV in the obtained yarn was 11.3 dL/g.

Example 2 (Ex. 2)

Yarns 2-1 and 2-2 were obtained identical to the process used for Yarn CE B, with the difference that 35 and 35.2 wt. % of filler have been used. Drawing ratios were respectively 200-210. Polymer IV in the final yarn was 15.0 dL/g.

Example 3 (Ex. 3)

Yarns 3-1 and 3-2 were obtained identical to the process used for Yarn CE B, with the difference that another type of filler was used. Alphawool filler grade AW03 from Morgan (numerical average diameter of 3.9 μm, average length of 70 μm, Moh's hardness of 9), 15 wt. % of filler have been used for Yarn 3-1 and 25 wt. % for yarn 3-2. Drawing ratios were respectively 206-209. Polymer IV in the final yarn was 14.2 dL/g.

TABLE 2

| | X | $IV_{UH}^{Y}$ [dL/g] | Total Draw Ratio | TEN [cN/dtex] | TEN/IV | Cut Force [N] | Yarn count [dtex] | Dust emission [g/kg yarn |
|---|---|---|---|---|---|---|---|---|
| Ex 1-1 | 0.143 | 11.3 | 210 | 15.7 | 1.39 | 7.6 | 220 | — |
| Ex 1-2 | 0.065 | 11.3 | 204 | 16.1 | 1.44 | 10.3 | 440 | 0.63 |
| Ex 2-1 | 0.35 | 15 | 205 | 9.0 | 0.60 | 9.5 | 220 | — |
| Ex 2-2 | 0.352 | 15 | 206 | 10.6 | 0.71 | 9.6 | 220 | — |
| Ex 3-1 | 0.15 | 14.2 | 209 | 16.7 | 1.18 | 10.1 | 440 | — |
| Ex 3-2 | 0.25 | 14.2 | 206 | 11.6 | 0.82 | 10.3 | 440 | — |

Coefficient of variation have been measured for yarn samples CE B-2 and Ex 1-2. Results are reported in Table 3.

TABLE 3

| | $IV_{UH}^{O}$ [dL/g] | X [—] | $IV_{UH}^{Y}$ [dL/g] | TEN [cN/dtex] | Ten [cN/dtex] | Dpf [dtex] | $CV_{inter}^{dpf}$ [%] | $CV_{inter}^{ten}$ [%] | $CV_{intra}^{TEN}$ [%] |
|---|---|---|---|---|---|---|---|---|---|
| CE B-2 | 22 | 0.065 | 15.0 | 16.3 | 20.1 | 3.37 | 15.68 | 16.34 | 1.12 |
| Ex 1-2 | 17 | 0.067 | 11.3 | 16.1 | 22.4 | 3.09 | 7.82 | 9.65 | 0.45 |

The invention claimed is:

1. A filled multifilament yarn comprising:

an ultrahigh molecular weight polyethylene (UHMWPE) with an intrinsic viscosity ($IV_{UH}^{Y}$) of <20 dL/g, a filler with a numerical average diameter of at least 1 μm and at most 20 μm and an aspect ratio L/D of at least 3 in an amount such that a ratio (χ) of the mass of the filler to a combined masses of the UHMWPE and filler is between 0.06 and 0.50, wherein $\chi > 0.004\ g/dL*IV_{UH}^{Y}$, and wherein the filled multifilament yarn has a tenacity (TEN) such that $TEN \geq IV_{UH}^{Y}*(1.5-3.25*\chi)$.

2. A filled multifilament yarn comprising:

an ultrahigh molecular weight polyethylene (UHMWPE) with an intrinsic viscosity ($IV_{UH}^{Y}$) of <20 dL/g, a filler with a numerical average diameter of at least 1 μm and at most 20 μm and an aspect ratio L/D of at least 3 in an amount such that the ratio (χ) of the mass of filler to the combined masses of the UHMWPE and filler is between 0.06 and 0.50, with $\chi \geq 0.004\ g/dL*IV_{UH}^{Y}$, wherein a filled monofilament in the filled multifilament yarn has a tenacity (ten) which is $ten \geq IV_{UH}^{Y}*(2-4.35*\chi)$.

3. The filled multifilament yarn of claim 1, wherein the ratio (χ) of the mass of filler to the combined masses of the UHMWPE and filler is between 0.06 and 0.40.

4. The filled multifilament yarn of claim 1, wherein $\chi \geq 0.0045\ g/dL*IV_{UH}^{Y}$.

5. The filled multifilament yarn of claim 1, wherein the filled multifilament yarn has a tenacity of at least 5.0 cN/dtex.

6. The filled multifilament yarn of claim 1, wherein the filler has a diameter which is at least 3 μm.

7. The filled multifilament yarn of claim 1, wherein the filler has a diameter which is at most 16 μm.

8. The filled multifilament yarn of claim 1, wherein the filler has an aspect ratio L/D of at least 5.

9. The filled multifilament yarn of claim 1, wherein $IV_{UH}^{Y}$ is at most 18 dL/g.

10. The filled multifilament yarn of claim 1, wherein the filler has an aspect ratio L/D of at least 10.

11. The filled multifilament yarn of claim 1, wherein the filler has an aspect ratio L/D of at least 20.

12. The filled multifilament yarn of claim 2, wherein the ratio (χ) of the mass of filler to the combined masses of the UHMWPE and filler is between 0.06 and 0.40.

13. The filled multifilament yarn of claim 2, wherein the tenacity of the filled monofilament is such that $ten\ IV_{UH}^{Y}*(2.5-4.35*\chi)$.

14. The filled multifilament yarn of claim 2, wherein $\chi \geq 0.0045\ g/dL*IV_{UH}^{Y}$.

15. The filled multifilament yarn of claim 2, wherein the filled multifilament yarn has a tenacity of at least 5.0 cN/dtex.

16. The filled multifilament yarn of claim 2, wherein the filler has a diameter which is at least 3 μm.

17. The filled multifilament yarn of claim 2, wherein the filler has a diameter which is at most 16 μm.

18. The filled multifilament yarn of claim 2, wherein the filler has an aspect ratio L/D of at least 5.

19. The filled multifilament yarn of claim 2, wherein $IV_{UH}^{Y}$ is at most 18 dL/g.

20. The filled multifilament yarn of claim 2, wherein the filler has an aspect ratio L/D of at least 10.

21. The filled multifilament yarn of claim 2, wherein the filler has an aspect ratio L/D of at least 20.

22. An article comprising the filled multifilament yarn of claim 1 or 2.

23. The article of claim 22 wherein the article is selected from the group consisting of fishing lines, fishing nets, ground nets, cargo nets, curtains, kite lines, dental floss, tennis racquet strings, canvas, woven cloths, nonwoven cloths, webbings, battery separators, medical devices, capacitors, pressure vessels, hoses, umbilical cables, automotive equipment, power transmission belts, building construction materials, cut resistant articles, stab resistant articles, incision resistant articles, protective gloves, composite sports equipment, skis, helmets, kayaks, canoes, bicycles and boat hulls, speaker cones, high performance electrical insulation, radomes, sails, and geotextiles.

24. A method for preparing the filled multifilament yarn of claim 1 comprising the steps of:

a) providing the UHMWPE having an intrinsic viscosity ($IV_{UH}^{0}$) of less than 24 dL/g, b) providing the filler with a diameter of at least 1 μm and at most 20 μm and an aspect ratio L/D of at least 3, c) preparing a solution of the UHMWPE in a solvent, the solution comprising the filler in an amount such that a ratio ($\chi$) of the mass of the filler to the combined masses of the UHMWPE and filler is between 0.06 and 0.50, wherein $\chi \geq 0.003$ g/dL*$IV_{UH}^{0}$, d) spinning the solution obtained in step c) through a multiple orifice die plate to form a solvent containing filled multifilament yarn, and e) at least partially removing the solvent from the filled yarn of step d) before, during or after drawing the filled yarn at a total draw ratio of at least 20 to thereby obtain the filled multifilament yarn.

25. The method of claim 24, wherein the ratio $\chi$ is between 0.06 and 0.40.

26. The method of claim 24, wherein $\chi \geq 0.0035$ g/dL*$IV_{UH}^{0}$.

27. The method of claim 24, wherein $IV_{UH}^{0}$ is less than 20 dL/g.

* * * * *